US009496617B2

(12) United States Patent
Ganchrow et al.

(10) Patent No.: US 9,496,617 B2
(45) Date of Patent: Nov. 15, 2016

(54) SURFACE WAVE LAUNCHED DIELECTRIC RESONATOR ANTENNA

(71) Applicant: QUALCOMM Incorporated, San Diego, CA (US)

(72) Inventors: Elimelech Ganchrow, Zichron Yaakov (IL); Alon Yehezkely, Haifa (IL)

(73) Assignee: QUALCOMM Incorporated, San Jose, CA (US)

( * ) Notice: Subject to any disclaimer, the term of this patent is extended or adjusted under 35 U.S.C. 154(b) by 50 days.

(21) Appl. No.: 14/558,305

(22) Filed: Dec. 2, 2014

(65) Prior Publication Data

US 2015/0207234 A1 Jul. 23, 2015

Related U.S. Application Data

(60) Provisional application No. 61/928,678, filed on Jan. 17, 2014.

(51) Int. Cl.

| | |
|---|---|
| ***H01Q 1/24*** | (2006.01) |
| ***H01Q 9/04*** | (2006.01) |
| ***H01Q 21/00*** | (2006.01) |
| ***H01Q 9/30*** | (2006.01) |
| ***H01Q 9/40*** | (2006.01) |

(52) U.S. Cl.

CPC ..... *H01Q 9/0485* (2013.01); *H01Q 1/243* (2013.01); *H01Q 9/30* (2013.01); *H01Q 9/40* (2013.01); *H01Q 21/0075* (2013.01)

(58) Field of Classification Search

CPC ..... H01Q 1/243; H01Q 9/0485; H01Q 9/30; H01Q 9/40; H01Q 21/0075

See application file for complete search history.

(56) References Cited

U.S. PATENT DOCUMENTS

| | | | | |
|---|---|---|---|---|
| 5,453,754 | A * | 9/1995 | Fray | H01Q 19/09 343/700 MS |
| 6,323,824 | B1 * | 11/2001 | Heinrichs | H01Q 1/242 343/785 |
| 7,504,721 | B2 | 3/2009 | Chen et al. | |
| 7,598,914 | B2 * | 10/2009 | Chang | H01Q 9/40 343/700 MS |

(Continued)

FOREIGN PATENT DOCUMENTS

| | | |
|---|---|---|
| GB | 2403069 A | 12/2004 |
| WO | 2009055895 A1 | 5/2009 |

OTHER PUBLICATIONS

Abeesh T. et al., "Design and studies on dielectric resonator on-chip antennas for millimeter wave wireless applications," International Conference on Signal Processing, Communication, Computing and Networking Technologies (ICSCCN), 2011, pp. 322-325.

(Continued)

*Primary Examiner* — Hoang V Nguyen

(74) *Attorney, Agent, or Firm* — Toler Law Group, PC

(57) ABSTRACT

An apparatus includes a printed circuit board having a first surface and a second surface opposite the first surface. The apparatus includes a surface launcher of a dielectric resonator antenna (DRA). The surface launcher is coupled to the first surface of the printed circuit board. A metal structure is coupled to the first surface and configured to direct a portion of a wave of the DRA through the second surface.

20 Claims, 5 Drawing Sheets

(56) References Cited

U.S. PATENT DOCUMENTS

| | | | | |
|---|---|---|---|---|
| 8,384,600 | B2 * | 2/2013 | Huang | H01Q 1/38 343/700 MS |
| 8,629,813 | B2 | 1/2014 | Milosavljevic | |
| 2009/0073074 | A1 | 3/2009 | Chang | |
| 2010/0231464 | A1 | 9/2010 | Huang et al. | |
| 2011/0032685 | A1 | 2/2011 | Akiba et al. | |
| 2013/0088396 | A1 | 4/2013 | Han | |
| 2013/0127669 | A1 | 5/2013 | Han et al. | |

OTHER PUBLICATIONS

Bijumon, P.V. et al., "Integrated Dielectric Resonator Antennas for System On-Chip Applications," International Conference on Microelectronics, 2007, pp. 275-278.

Wahab, Wael M. Abdel et al., "Low Cost Planar Waveguide Technology-Based Dielectric Resonator Antenna (DRA) for Millimeter-Wave Applications: Analysis, Design, and Fabrication," IEEE Transactions on Antennas and Propagation, Aug. 2010, vol. 58 (8), pp. 2499-2507.

International Search Report and Written Opinion—PCT/US2014/068367—ISA/EPO—Mar. 16, 2015, 15 pages.

* cited by examiner

SURFACE WAVE LAUNCHED DIELECTRIC RESONATOR ANTENNA

I. CROSS-REFERENCE TO RELATED APPLICATIONS

The present application claims priority from U.S. Provisional Patent Application No. 61/928,678, filed Jan. 17, 2014 and entitled "SURFACE WAVE LAUNCHED DIELECTRIC RESONATOR MILLIMETER-WAVE ANTENNA," the content of which is incorporated by reference in its entirety.

II. FIELD

The present disclosure is generally related to electronics, and more specifically to radio frequency integrated circuits (RFICs).

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Due to narrow beam/high gain components used in 60 gigahertz (GHz) communications systems, use of multidirectional antennas (i.e. antennas that receive/transmit signals in all directions) for such systems enables communication using a reduced number of antennas as compared to using non-multidirectional antennas. Mobile phone configurations may include a module (that includes an antenna) that is soldered to a printed circuit board (PCB). In this case, the metallic structures of the PCB, such as one or more metal layers on an underside of the PCB, block, or reduce, signal reception of antennas in the module. That is, an antenna in the module may have poor reception (or no reception) of signals from a direction below the mobile phone PCB, and the antenna may therefore lose (or substantially lose) an entire hemisphere of potential 60 GHz coverage.

IV. BRIEF DESCRIPTION OF THE DRAWINGS

V. DETAILED DESCRIPTION

The detailed description set forth below is intended as a description of exemplary designs of the present disclosure and is not intended to represent the only designs in which the present disclosure can be practiced. The term "exemplary" is used herein to mean "serving as an example, instance, or illustration." Any design described herein as "exemplary" is not necessarily to be construed as preferred or advantageous over other designs. The detailed description includes specific details for the purpose of providing a thorough understanding of the exemplary designs of the present disclosure. It will be apparent to those skilled in the art that the exemplary designs described herein may be practiced without these specific details. In some instances, well-known structures and devices are shown in block diagram form in order to avoid obscuring the novelty of the exemplary designs presented herein.

Figure 1:
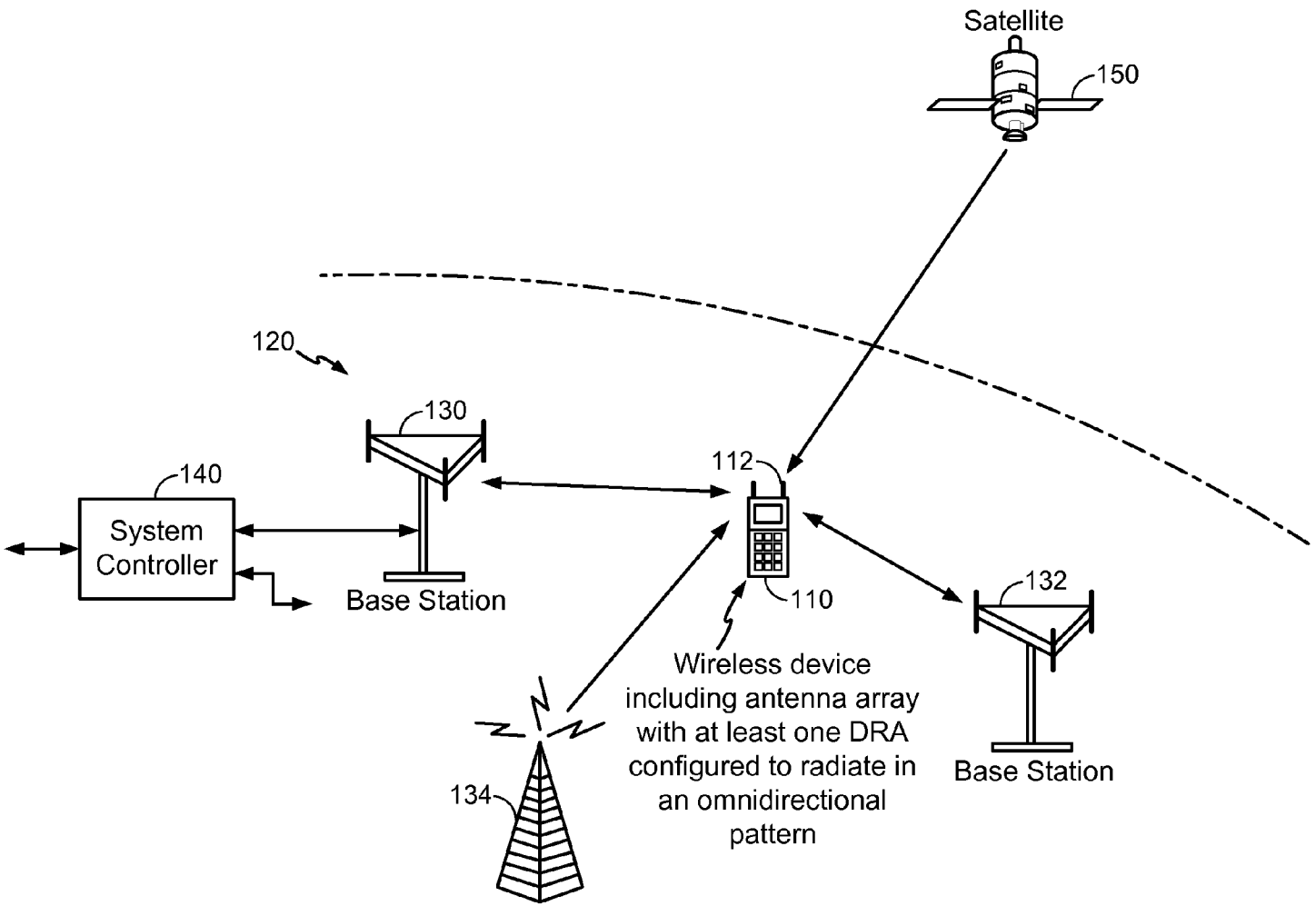
FIG. 1 shows a wireless device communicating with a wireless system.

FIG. 1 shows a wireless device 110 communicating with a wireless communication system 120. The wireless device 110 includes an antenna 112. The antenna 112 may be part of an antenna array having at least one dielectric resonator antenna (DRA), as further described herein. Wireless communication system 120 may be a Long Term Evolution (LTE) system, a Code Division Multiple Access (CDMA) system, a Global System for Mobile Communications (GSM) system, a wireless local area network (WLAN) system, a 60 GHz system, a millimeter (mm)-wave system, a system that operates in accordance with one or more Institute of Electrical and Electronics Engineers (IEEE) 802.11 standards or protocols, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA. For simplicity, FIG. 1 shows wireless communication system 120 including two base stations 130 and 132 and one system controller 140. In general, a wireless system may include any number of base stations and any set of network entities.

Wireless device 110 may also be referred to as user equipment (UE), a mobile station, a terminal, an access terminal, a subscriber unit, a station, etc. Wireless device 110 may be a cellular phone, a smartphone, a tablet, a wireless modem, a personal digital assistant (PDA), a handheld device, a laptop computer, a smartbook, a netbook, a cordless phone, a wireless local loop (WLL) station, a Bluetooth device, etc. Wireless device 110 may communicate with the wireless communication system 120. Wireless device 110 may also receive signals from broadcast stations (e.g., a broadcast station 134), signals from satellites (e.g., a satellite 150) in one or more global navigation satellite systems (GNSS), etc. Wireless device 110 may support one or more radio technologies for wireless communication such as LTE, WCDMA, CDMA 1X, EVDO, TD-SCDMA, GSM, 802.11, 60 GHz, mm-wave, etc. The wireless device 110 includes at least one dielectric resonator antenna (DRA) (e.g., the antenna 112) configured to radiate in an omnidirectional pattern. An exemplary DRA is further described with reference to FIG. 3.

Figure 2:
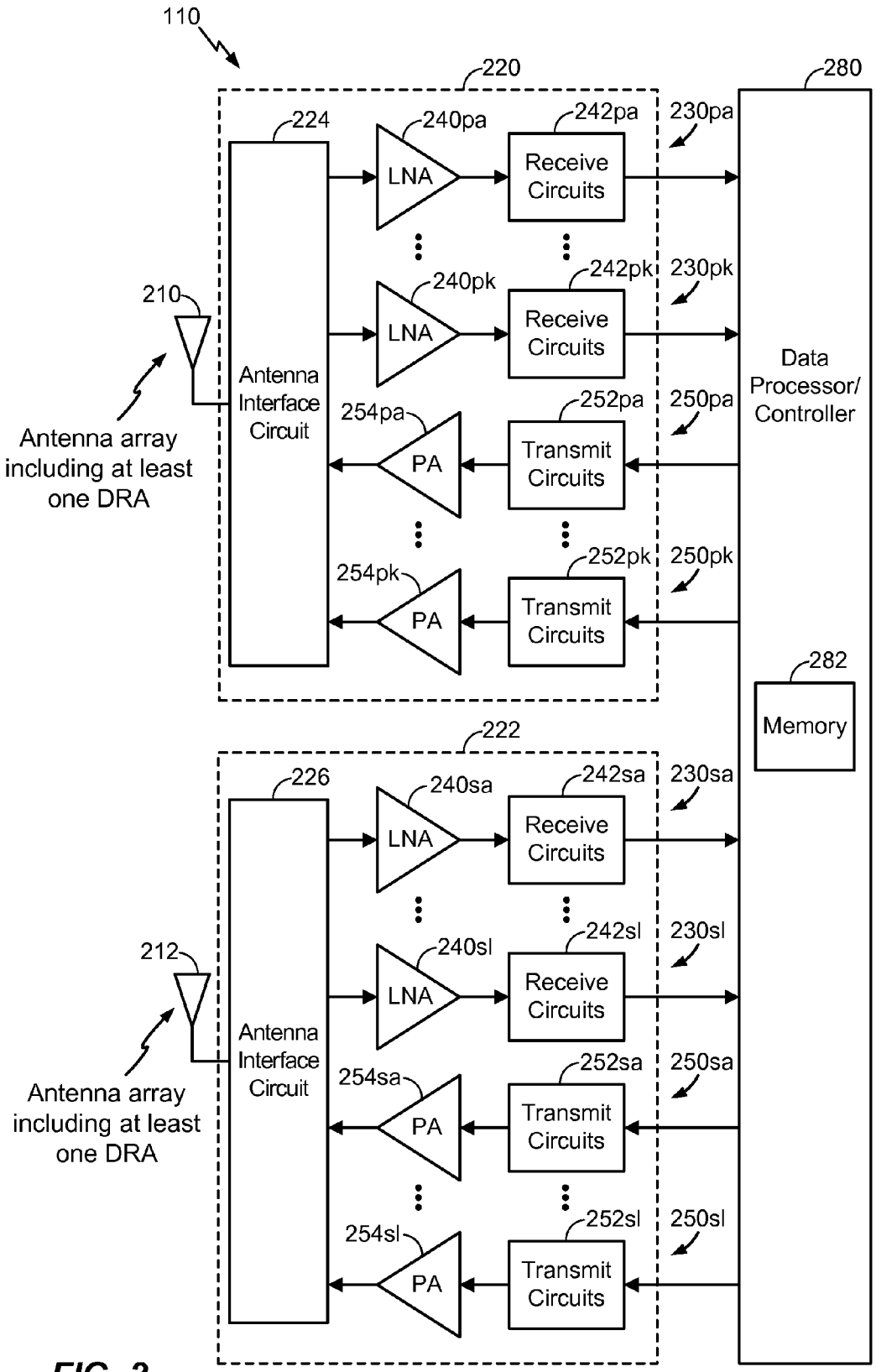
FIG. 2 shows a block diagram of the wireless device in FIG. 1.

FIG. 2 shows a block diagram of an exemplary design of the wireless device 110 in FIG. 1. In this exemplary design, the wireless device 110 includes a transceiver 220 coupled to a primary antenna array 210, a transceiver 222 coupled to a secondary antenna array 212 (e.g., via antenna interface circuit 226), and a data processor/controller 280. The primary antenna array 210 and the secondary antenna array 212 may include at least one DRA. The antenna arrays 210, 212 may be separate or part of a single larger antenna array. Transceiver 220 includes multiple (K) receivers 230*pa* to 230*pk* and multiple (K) transmitters 250 *pa* to 250*pk* to support multiple frequency bands, multiple radio technologies, carrier aggregation, etc. Transceiver 222 includes multiple (L) receivers 230*sa* to 230*sl* and multiple (L) transmitters 250*sa* to 250*sl* to support multiple frequency bands, multiple radio technologies, carrier aggregation, receive diversity, multiple-input multiple-output (MIMO) transmission from multiple transmit antennas to multiple receive antennas, etc.

In the exemplary design shown in FIG. 2, each receiver 230 includes an LNA 240 and receive circuits 242. For data reception, the primary antenna array 210 receives signals from base stations and/or other transmitter stations and provides a received RF signal, which is routed through an antenna interface circuit 224 and presented as an input RF signal to a selected receiver. Antenna interface circuit 224 may include switches, duplexers, transmit filters, receive filters, matching circuits, etc. The description below assumes that receiver 230*pa*, an LNA 240*pa* amplifies the input RF signal and provides an output RF signal. Receive circuits 242*pa* downconvert the output RF signal from RF to baseband, amplify and filter the downconverted signal, and provide an analog input signal to data processor/controller 280. Receive circuits 242*pa* may include mixers, filters, amplifiers, matching circuits, an oscillator, a local oscillator (LO) generator, a phase locked loop (PLL), etc. Each remaining receiver 230 in transceivers 220 and 222 may operate in a similar manner as receiver 230*pa*.

In the exemplary design shown in FIG. 2, each transmitter 250 includes transmit circuits 252 and a power amplifier (PA) 254. For data transmission, data processor/controller 280 processes (e.g., encodes and modulates) data to be transmitted and provides an output signal to a selected transmitter. The description below assumes that transmitter 250*pa* is the selected transmitter. Within transmitter 250*pa*, transmit circuits 252*pa* amplify, filter, and upconvert the output signal from baseband to RF and provide a modulated RF signal. Transmit circuits 252*pa* may include amplifiers, filters, mixers, matching circuits, an oscillator, an LO generator, a PLL, etc. A PA 254*pa* receives and amplifies the modulated RF signal and provides a transmit RF signal. The transmit RF signal is routed through antenna interface circuit 224 and transmitted via the antenna array 210. Each remaining transmitter 250 in transceivers 220 and 222 may operate in a similar manner as transmitter 250*pa*.

FIG. 2 shows an exemplary design of receiver 230 and transmitter 250. A receiver and a transmitter may also include other circuits not shown in FIG. 2, such as filters, matching circuits, etc. All or a portion of transceivers 220 and 222 may be implemented on one or more analog integrated circuits (ICs), RF ICs (RFICs), mixed-signal ICs, etc. For example, LNAs 240 and receive circuits 242 may be implemented on one module, which may be an RFIC, etc. The circuits in transceivers 220 and 222 may also be implemented in other manners.

Data processor/controller 280 may perform various functions for wireless device 110. For example, data processor/controller 280 may perform processing for data being received via receivers 230 and data being transmitted via transmitters 250. Data processor/controller 280 may control the operation of the various circuits within transceivers 220 and 222. A memory 282 may store program codes and data for data processor/controller 280. Data processor/controller 280 may be implemented on one or more application specific integrated circuits (ASICs) and/or other ICs.

Figure 3:
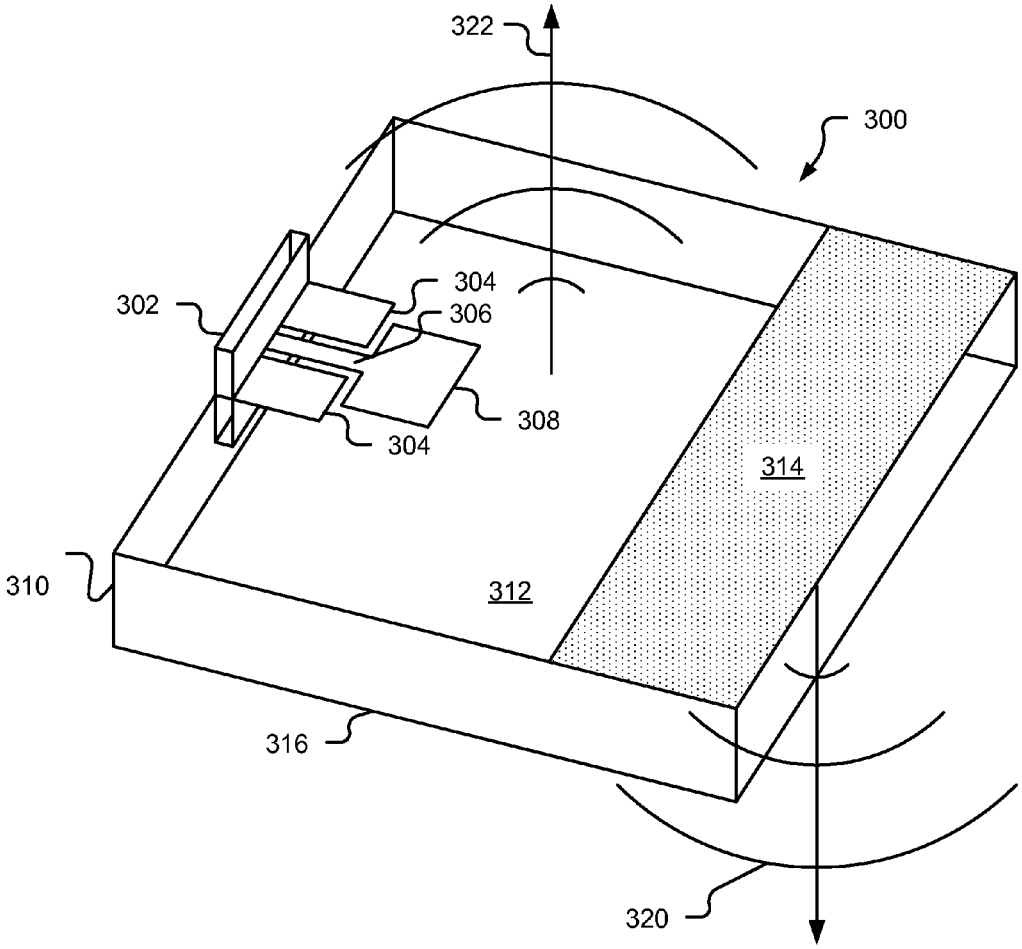
FIG. 3 shows a diagram of a dielectric resonator antenna (DRA)

Wireless device 110 may support multiple frequency band groups, multiple radio technologies, and/or multiple antennas (which may include one or more DRAs). Wireless device 110 may include a number of LNAs to support reception via the multiple frequency band groups, the multiple radio technologies, and/or the multiple antennas. In an exemplary embodiment, as shown in FIG. 3, a printed circuit board (PCB) (or other type of substrate that supports circuitry) supports a coplanar waveguide, a surface launcher for a DRA (e.g., a DRA that is part of the primary antenna array 210 or the secondary antenna array 212 of FIG. 2), and a metal structure to direct energy in many different directions. The PCB has a dielectric substrate that is used as part of the DRA.

FIG. 3 illustrates an exemplary embodiment of a DRA 300 with a PCB 310 having a feedport 302, multiple ground planes 304, a co-planar waveguide 306, and a surface launcher 308 for the DRA 300. The feedport 302 is coupled to the surface launcher 308 by the co-planar waveguide 306. The waveguide 306 is characterized as being "co-planar" because the ground planes 304 and a signal/feed line between the ground planes are co-planar, as shown in FIG. 3. The surface launcher 308 is also planar. The surface launcher 308 is co-planar with the waveguide 306 and is attached to a top surface 312 of the PCB 310. It should be noted although FIG. 3 illustrates a rectangular surface launcher 308, a surface launcher may have other shapes (e.g., square) in alternative embodiments, so long as the surface launcher has enough metal to be resonant and to launch a wave inside a dielectric, as further described herein with reference to the surface launcher 308. The PCB 310 also includes a metal structure 314 that is attached to the top surface 312 of the PCB 310. The feedport 302 is illustrated as a generic signal input and the feedport 302 as illustrated may not be included in an operating device (e.g., the feedport 302 is optional).

During operation, a signal is communicated by the feedport 302, the co-planar waveguide 306, and the surface launcher 308, and the signal is reflected and redirected by the metal structure 314 into many different directions. As a non-limiting exemplary implementation, energy associated with a 60 GHz signal (e.g., a 60 GHz signal from a radio frequency integrated circuit (RFIC) (e.g., an RFIC attached to the PCB 310) within the wireless device 110) is radiated by the DRA 300 and by the dielectric layer of the PCB 310 functioning as part of the DRA 300. To illustrate, the surface launcher 308 may launch a wave in the PCB 310 that may resonate in accordance with one or more resonant modes of a dielectric of the PCB 310. A portion of the wave between the surface launcher 308 and the metal structure 314 may generate radiation having a component in a direction 322 (e.g., upward from the top surface 310 and opposite a direction 320 downward from the bottom surface 316). A portion of the wave is re-directed by the metal structure 314 toward and through a bottom surface 316 (that is opposite the top surface 312 of the PCB 310) to generate a portion of a radiation pattern beyond the bottom surface 316. For example, the portion of the wave that is re-directed by the metal structure 314 may have a component that is reflected by a dielectric/air interface at the bottom surface 316 back into the PCB 310 and may also have another component that is transmitted through the bottom surface 316 to contribute to the far-field radiation pattern (e.g., an omnidirectional radiation pattern) of the DRA 300. Propagation of the portion of the radiated energy below the bottom surface 316 may be enabled by an absence of any ground plane proximate to the bottom surface 316.

The DRA 300 may therefore be configured to radiate energy in an "omnidirectional" pattern. In an exemplary embodiment, the radiated energy may be a component of a 60 GHz signal. It should be noted that as used herein, radiating in an "omnidirectional" pattern may include, but does not require, an ability to radiate spherically in all directions. Radiating in an omnidirectional pattern may also include radiating in multiple directions including a direction to reach objects above the PCB 310 and a direction to reach objects (e.g., objects such as other devices having antennas configured to receive transmissions from the DRA 300, such as mobile phones, wireless network access points, etc., and/or additional parts of a wireless device, a mobile case, an object external to the mobile case, etc.) below the PCB 310. As another example, radiating in an omnidirectional pattern may include radiating energy such that a hemisphere is not blocked. Thus, in an exemplary embodiment, energy is radiated in an omnidirectional pattern, and radiated energy may exit the bottom surface 316 of the PCB instead of being blocked and/or reflected by a ground plane. At least a portion of such energy is redirected by the metal structure 314 to a direction toward the bottom surface 316 of the PCB 310 and then in a direction 320 below the PCB 310 (e.g., to objects below the bottom surface 316). In this manner, an antenna of a mobile device may radiate in all directions (e.g. in three dimensions including directions 320 and 322) and is not limited to only one hemisphere. As a result, the DRA 300 has improved reception and improved performance (as compared to antennas within an RF module of a mobile phone that has metallic structures in a PCB). As an example, such improved directionality may be useful in 60 GHz systems, where wavelengths are on the order of a few millimeters (mm-wave). In accordance with the described techniques, a DRA may be configured to radiate in an omnidirectional pattern. Alternatively, or in addition, a device may include multiple that are collectively configured to radiate in an omnidirectional pattern (although one or more individual DRAs may not radiate omnidirectionally).

The disclosed exemplary DRA 300 allows a PCB to be part of a radiating structure without strict demands on manufacturing capabilities and material properties. The exemplary DRA 300 is also relatively insensitive to nearby structures. The disclosed exemplary antenna design allows for more antennas to be utilized with a small footprint of a system in package (SiP). For example, the disclosed DRA may be relatively small and may utilize a dielectric/PCB that functions a resonator. In addition, a portion of radiated energy from the DRA 300 is radiated on the underside of the PCB 310, which improves antenna coverage. It should be noted that in alternative embodiments, the described DRA may utilize a substrate other than a PCB, such as another type of dielectric material.

Figure 4:
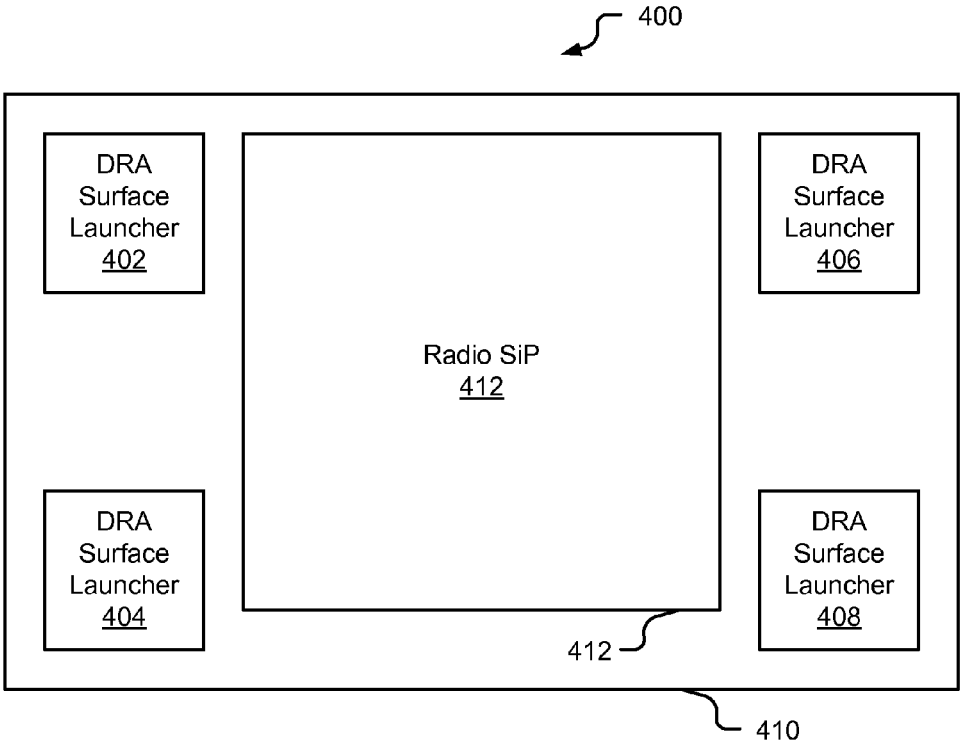
FIG. 4 shows a system level view of a four DRA design including a radio frequency system in package (SiP)

FIG. 4 illustrates an exemplary system 400. In this example, DRA launchers 402-408 are located on the main PCB 410 (or on a daughter card of the Radio SiP 412). The DRA launchers 402-408 excite a waveguide mode in the PCB 410 that can radiate to the other (e.g., an opposite) side of the PCB. FIG. 4 illustrates an exemplary four DRA design. The Radio SiP 412 includes other (e.g., non-DRA) antennas (e.g., chip antennas, monopole antennas, bipole antennas, inverted f-type antennas, meander antennas, patch antennas, etc.). The exemplary DRA antennas (i.e., the surface launchers 402-408 and the PCB 410) add antenna diversity and may be used for radiation pattern shaping and for use in narrowband applications (such as 60 GHz and mm-wave). In an exemplary embodiment, the DRAs of FIG. 4 are collectively configured to radiate in an omnidirectional pattern.

In accordance with a described embodiment, a feed may be used to excite a mode inside the dielectric substrate of a motherboard (e.g., PCB). The feed may be a surface wave that emanates from a feed point and travels on the dielectric surface and/or within the dielectric. The feed may be radiated when the feed reaches a metallic or dielectric boundary. When there is sufficient space for the surface wave to be launched, a topology surrounding the feed point may not be critical to impedance match, which may enable a device that includes the feed point and the motherboard to be more robust and less sensitive to PCB thickness and surrounding structures. It will be appreciated that the described antenna design is compatible with different packaging. The surface wave may radiate from the motherboard in different directions, including but not limited to, a backside (e.g., bottom) of the motherboard, and metallic structures may be added to the surface of the motherboard to encourage (e.g., redirect) field(s) to radiate in particular (e.g., desired) directions.

In an exemplary embodiment, a solder ball or similar device may be connected from a chip (e.g., integrated circuit) to a substrate of the motherboard, and a signal may pass through the solder ball or similar device. As described with reference to FIG. 3, a co-planar transition may be used as a waveguide, although other transmission lines (e.g., microstrip or stripline) may be used in alternative embodiments. A surface launcher (e.g., launching stub) may excite a mode in the PCB (or substrate), and a wider surface launcher may lead to a broader match for excitation. The mode launched in the PCB (or substrate) may cause the PCB (or substrate) to act as a DRA whose radiation pattern and gain are determined based on a size and topology of the PCB (or substrate). Metallic directors (e.g., structures) may be placed on the surface of the PCB (or substrate) to guide a wave launched in the PCB and to cause the wave to be radiated in various directions. In an illustrative embodiment, the described antenna may be a mm-wave DRA.

Figure 5:
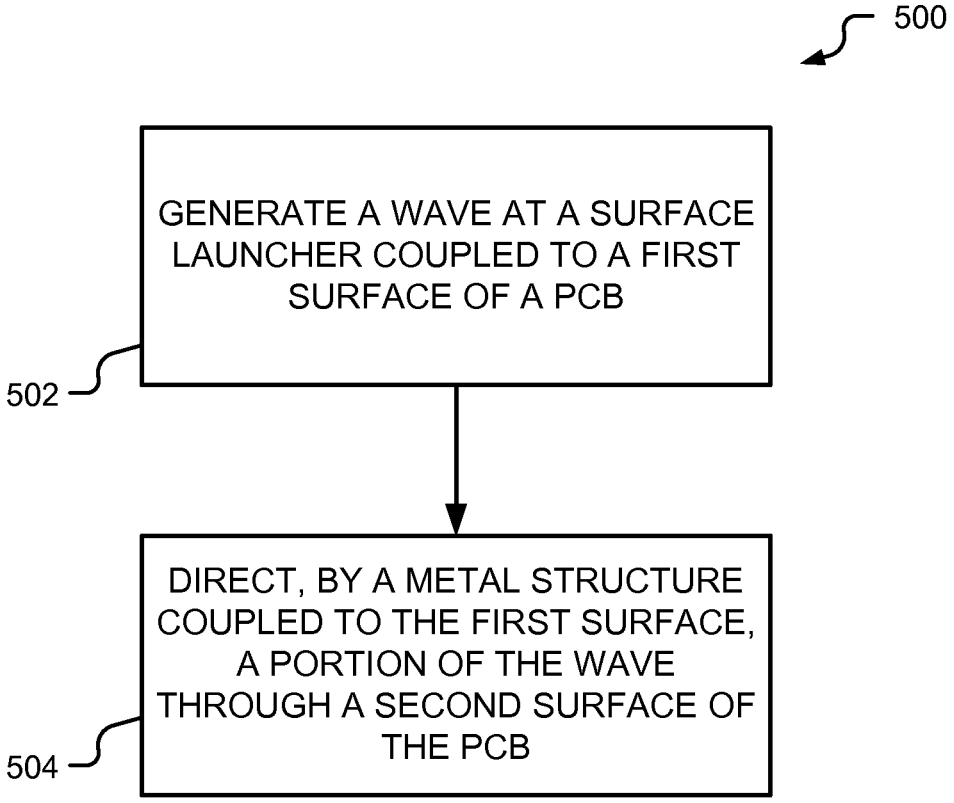
FIG. 5 is a flowchart that illustrates a method of communicating signals using a DRA.

FIG. 5 is a flowchart to illustrate a particular embodiment of a method 500 of operation at the wireless device 110. The method 500 includes generating a wave at a surface launcher coupled to a first surface of a PCB, at 502. For example, the surface launcher 308 of the DRA 300 may receive a signal from a radio frequency circuit (e.g., an RFIC) of the PCB 310. A portion of the wave may be directed, by a metal structure coupled to the first surface, through a second surface of the PCB, at 504. To illustrate, referring to FIG. 3, the metal structure 314 may redirect at least a portion of signal energy corresponding to a wave launched by the surface launcher 308 in the direction 320 toward and through the bottom surface 316 of, and to objects below, the PCB 310. The method may also include radiating energy associated with the wave at the DRA in an omnidirectional pattern. For example, the omnidirectional pattern can include a portion of the energy that is radiated in a direction having a component in the direction 322 of FIG. 3 (e.g., above the PCB 310) and a portion of the energy that is radiated in another direction having a component in the direction 320 of FIG. 3 (e.g., below the PCB 310).

In conjunction with the described embodiments, an apparatus includes means for supporting and electrically connecting electronic components. The means for supporting and electrically connecting electronic components has a first surface and a second surface opposite the first surface. The means for supporting and electrically connecting electronic components may include the PCB 310 of FIG. 3 or the PCB 410 of FIG. 4, as illustrative, non-limiting examples.

The apparatus may include means for launching a wave of a dielectric resonator antenna (DRA). The means for launching is coupled to the first surface. The means for launching may include the surface launcher 308 or one or more of the DRA surface launchers 402-408 of FIG. 4, as illustrative, non-limiting examples.

The apparatus may include means for redirecting a portion of the wave through the second surface. The means for redirecting may include the metal structure 314 as an illustrative, non-limiting example.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. An apparatus comprising:

a printed circuit board having a first surface and a second surface opposite the first surface;

a surface launcher of a dielectric resonator antenna, the surface launcher coupled to the first surface of the printed circuit board, wherein the surface launcher is configured to generate a wave within a dielectric of the printed circuit board; and a metal structure having a substantially rectangular shape and configured to direct a portion of the wave of the dielectric resonator antenna through the second surface, wherein the metal structure is coupled to the first surface without being coupled to a ground plate of the printed circuit board.

2. The apparatus of claim 1, wherein the dielectric of the printed circuit board is coupled to the surface launcher to cause the dielectric to function as a resonator of the dielectric resonator antenna.

3. The apparatus of claim 1, further comprising a second surface launcher of a second dielectric resonator antenna coupled to the first surface of the printed circuit board.

4. The apparatus of claim 1, wherein the surface launcher is planar.

5. The apparatus of claim 1, further comprising a coplanar waveguide coupled to the first surface of the printed circuit board and coupled to the surface launcher.

6. The apparatus of claim 1, wherein the portion of the wave directed through the second surface corresponds to a portion of an omnidirectional radiation pattern of the dielectric resonator antenna.

7. The apparatus of claim 6, wherein a second portion of the wave corresponds to another portion of the omnidirectional radiation pattern.

8. The apparatus of claim 7, wherein energy radiated by a dielectric of the printed circuit board includes a component of a signal communicated by the dielectric resonator antenna and wherein the signal comprises a 60 gigahertz (GHz) signal.

9. The apparatus of claim 1, further comprising:

a radio frequency system in package; and a second surface launcher coupled to the first surface of the printed circuit board.

10. The apparatus of claim 9, wherein the radio frequency system in package further includes a plurality of non-dielectric resonator antenna antennas.

11. The apparatus of claim 10, wherein the non-dielectric resonator antenna antennas comprise monopole antennas, bipole antennas, inverted f-type antennas, meander antennas, patch antennas, or chip antennas.

12. A method for operating a dielectric resonator antenna (DRA), comprising:

generating a wave at a surface launcher coupled to a first surface of a printed circuit board that has a second surface opposite the first surface, wherein the wave is generated within a dielectric of the printed circuit board; and directing, by a metal structure having a substantially rectangular shape, a portion of the wave through the second surface, wherein the metal structure is coupled to the first surface without being coupled to a ground plane of the printed circuit board.

13. The method of claim 12, wherein the metal structure redirects at least a portion of energy radiated by the dielectric resonator antenna to propagate in a direction to reach objects below the PCB.

14. An apparatus comprising:

means for supporting and electrically connecting electronic components, the means for supporting and electrically connecting electronic components having a first surface and a second surface opposite to the first surface;

means for launching a wave of a dielectric resonator antenna, wherein the wave is generated within a dielectric of the means for supporting and electrically connecting electronic components and the means for launching is coupled to the first surface; and means for redirecting a portion of the wave through the second surface, wherein the means for redirecting is substantially rectangular and is coupled to the first surface without being coupled to a ground plane of the means for supporting and electrically connecting electronic components.

15. The apparatus of claim 14, wherein the means for supporting and electrically connecting electronic components includes a printed circuit board, and wherein a dielectric of the printed circuit board is coupled to the means for launching to cause the dielectric to function as a resonator of the dielectric resonator antenna.

16. The apparatus of claim 14, wherein the means for launching is planar.

17. The apparatus of claim 14, further comprising a coplanar waveguide coupled to the first surface of the means for supporting and electrically connecting electronic components and coupled to the means for launching.

18. The apparatus of claim 14, wherein the means for redirecting is coupled to the first surface of the means for supporting and electrically connecting electronic components.

19. The apparatus of claim 18, wherein the first surface is a top surface of the means for supporting and electrically connecting electronic components, wherein the second surface is a bottom surface of the means for supporting and electrically connecting electronic components, and wherein the means for redirecting is configured to direct a portion of energy radiated from the dielectric resonator antenna toward objects below the bottom surface of the means for supporting and electrically connecting electronic components.

20. The apparatus of claim 19, wherein the energy radiated from the dielectric resonator antenna includes a component of a 60 gigahertz (GHz) signal.

* * * * *